US006129619A

United States Patent [19]

Bergqvist

[11] Patent Number: 6,129,619

[45] Date of Patent: Oct. 10, 2000

[54] METHODS AND APPARATUS FOR SUPPLYING FLUSHING FLUID TO A GRINDING HEAD

[75] Inventor: Arne Bergqvist, Sandviken, Sweden

[73] Assignee: Sandvik AB, Sandviken, Sweden

[21] Appl. No.: 09/271,924

[22] Filed: Mar. 18, 1999

Related U.S. Application Data

[62] Division of application No. 08/656,358, filed as application No. PCT/SE94/01191, Dec. 12, 1994, Pat. No. 5,885,136.

[30] Foreign Application Priority Data

Dec. 14, 1993 [SE] Sweden ..... 9304139

[51] Int. Cl.[7] ..... B24B 55/02

[52] U.S. Cl. ..... 451/450; 451/424

[58] Field of Search ..... 451/48, 53, 446, 451/450, 442, 448, 449, 415, 424

[56] References Cited

U.S. PATENT DOCUMENTS

| | | |
|---|---|---|
| 2,455,597 | 12/1948 | Metzger et al. . |
| 3,229,427 | 1/1966 | Goodhew . |
| 4,102,084 | 7/1978 | Bloomquist . |
| 4,616,738 | 10/1986 | Shurtliff . |
| 4,858,388 | 8/1989 | Bice . |
| 5,070,654 | 12/1991 | Manqvist et al. . |
| 5,637,037 | 6/1997 | Bergqvist . |
| 5,639,273 | 6/1997 | Sjolander et al. . |

FOREIGN PATENT DOCUMENTS

| | | |
|---|---|---|
| 460 584 | 10/1989 | Sweden . |
| 819 417 | 9/1959 | United Kingdom . |
| 2 008 997 | 6/1979 | United Kingdom . |

*Primary Examiner*—Eileen P. Morgan
*Attorney, Agent, or Firm*—Burns, Doane, Swecker & Mathis, L.L.P.

[57] ABSTRACT

Button inserts of a rock drilling bit are ground by positioning a grinding cup against each button insert and rotating the cup while supplying flushing fluid thereto. The flushing fluid is conducted through an axial bore of a spindle on which the grinding cup is mounted. An inner end of the spindle is mounted for rotation in a grinding head, and is rotated by a drive mechanism disposed within the grinding head. Flushing fluid is supplied to the axial bore through a flushing head mounted on the spindle at a location outside of the grinding head. The flushing head has axially spaced parts that are movable axially relative to one another under the force of flushing fluid passing therethrough, in order to establish a fluid seal.

4 Claims, 2 Drawing Sheets

METHODS AND APPARATUS FOR SUPPLYING FLUSHING FLUID TO A GRINDING HEAD

This application is a Divisional of application Ser. No. 08/656,358, filed Aug. 12, 1996 now U.S. Pat. No. 5,885, 136 issued Mar. 23, 1999 which is a 371 of PCT/SE94/01191 filed Dec. 12, 1994.

BACKGROUND OF THE INVENTION

The present invention relates to a method and apparatus for grinding buttons of a rock drilling bit, and to a flushing head for supplying flushing medium.

From e.g. SE-B460 584 a device for grinding buttons of a rock drilling bit is previously known, said device including a grinding head having a rotatably journalled spindle that receives a grinding cup. Inside the grinding head means are provided for supplying flushing/cooling medium to a recess of the grinding cup. Said flushing/cooling medium is supplied axially within the rotatable spindle and then axially within the shank of the grinding cup until the flushing/cooling medium reaches the recess of the grinding cup. However, due to the fact that the means for supplying flushing/cooling medium to the grinding cup is located within the grinding head considerable sealing arrangements for separating the flushing/cooling medium from the lubricating medium must be present. This complicates the design of the grinding head.

The aim of the present invention is to present a method/device/flushing head for grinding buttons of rock drilling bits, said method/device/flushing head simplifying the supply of flushing/cooling medium to the grinding cup. Below an embodiment of the device/flushing head according to the invention is described, reference being made to the accompanying drawings where FIG. 1 shows a section of a grinding head of the device according to the present invention; and FIG. 2 shows in detail a section of a flushing head of the device shown in FIG. 1.

DETAILED DESCRIPTION OF A PREFERRED EMBODIMENT OF THE INVENTION

Figure 1:
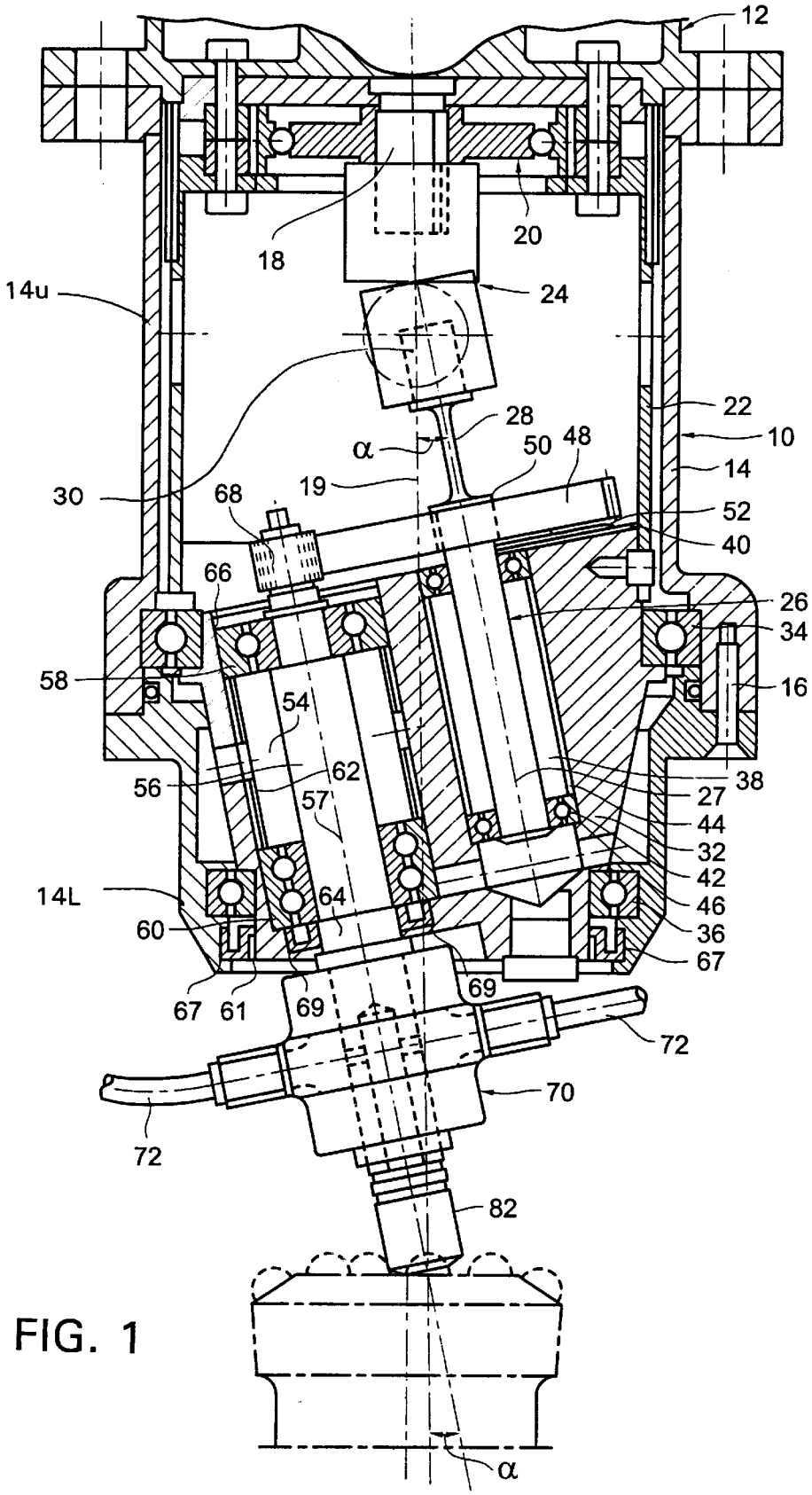

As is apparent from FIG. 1 the device according to the present invention includes a grinding head 10 that is secured to a power source 12, preferably an electric motor that is only schematically disclosed. The grinding head 10 can be displaced vertically, i.e. downwards and upwards, by an arrangement that is not disclosed.

The grinding head 10 includes an outer 14 that is stationary. For mounting and service reasons the case includes an upper section 144 and a lower section 142 that are coupled to each other by bolts 16.

A protruding shaft 18 of the power source 12 extends into the grinding head 10, said shaft 18 being rotatable relative to first longitudinal center axis 19. On an intermediate portion of the shaft 18 a gear means 20 is mounted, preferably an eccentric gear means. Said gear means 20 is coupled to a driving sleeve 22 that is located inside the outer casing 14. Due to the transmission ratio of the gear means 20 the driving sleeve 22 is rotated much more slowly than the shaft 18. As typical values can be mentioned that if the shaft 18 rotates by 3000 r.p.m then the driving sleeve 22 rotates by about 40 r.p.m.

On the free end of the protruding shaft 18 one end of a cardan joint 24 is mounted. The other end of the cardan joint 24 is mounted on an intermediate shaft 26 that is provided with a diameter reduction 28 close to the cardan joint 24. Said diameter reduction 28 serves the purpose to impart a certain flexibility to the intermediate shaft 26 to compensate in case that the rotation center 30 of the cardan joint 24 does not exactly coincide with the longitudinal center axis 19.

The intermediate shaft 26 has a second longitudinal centre axis 27 that due to the cardan joint 24 is allowed to form an acute angle $\alpha$ with the first longitudinal centre axis 19. The angle $\alpha$ is in the interval 5°–15°, with preference for values in the magnitude of 10°.

Integrally with the driving sleeve 22 a spindle house 32 is provided, said spindle house 32 being journalled by first 34 and second 36 ball bearings that are axially spaced apart within the outer casing 14.

The end of the intermediate shaft 26, remote from the cardan joint 24, is journalled in a first boring 38 of the spindle house 32. Said end of the intermediate shaft 26 is supported by third 40 and fourth 42 ball bearings that are axially spaced apart, by a first distance sleeve 44, in the longitudinal direction of the intermediate shaft 26. The fourth ball bearing 42 is supported by a first step 46. The longitudinal centre axis of the first boring 38 coincides with the second longitudinal centre axis 27.

Between the diameter reduction 28 and the third ball bearing 40 a first gear wheel 48 is mounted, said first gear wheel 48 being axially fixed between a collar 50 on the intermediate shaft 26 and a spacing member 52 located between the third ball bearing 40 and the first gear wheel 48. In a second boring 54 of the spindle house 32 a grinding spindle 56 is rotatably journalled by fifth 58 and sixth 60 ball bearings that are axially spaced apart, by a second distance sleeve 62, in the longitudinal direction of the grinding spindle 56. The sixth ball bearing 60 rests on a second step 61. Since the sixth ball bearing 60 is of double row type it supports the grinding spindle 56 in both axial and radial direction. The support in axial direction is effected via a collar 64 of the grinding spindle 56. The ball bearing 58 is axially locked by a washer 66. The rotation of the grinding spindle 56 is relative to a third longitudinal centre axis 57 of the grinding spindle 56, said third longitudinal centre axis 57 being parallel to the second longitudinal centre axis 27. Thus, the third longitudinal centre axis 57 forms an angle $\alpha$ with the first longitudinal centre axis 19. The longitudinal centre axis of the second boring 54 coincides with the third longitudinal centre axis 57.

At its upper end the grinding spindle 56 carries a second gear wheel 68 having a considerably smaller diameter than the first gear wheel 48. This means that the grinding spindle 56 will rotate considerably faster than the intermediate shaft 26. The protruding shaft 18 rotates with the same r.p.m. as the intermediate shaft 26. As pointed out above a typical value is 3000 r.p.m. The transmission ratio between the first 48 and second 68 gear wheel is typically of such magnitude that the grinding spindle 56 will rotate by about 13000 r.p.m.

Due to the cardan joint 24 it is possible to use gear wheels 48,68 of standard type, i.e. gear wheels having a generally cylindrical outer periphery.

Between the lower end of the outer casing 14 and the lower end of spindle house 32 a first sealing means 67 is provided and between the lower end of the second boring 54 and the grinding spindle 56 and a second sealing means 69 is provided. For lubrication purposes oil is present in the interior of the grinding house 10. The upper level of the oil preferably reaches the upper part of the spindle head 32. The sealing means 67 and 69 have the purpose to prevent oil from leaking out from the grinding head 10.

Figure 2:
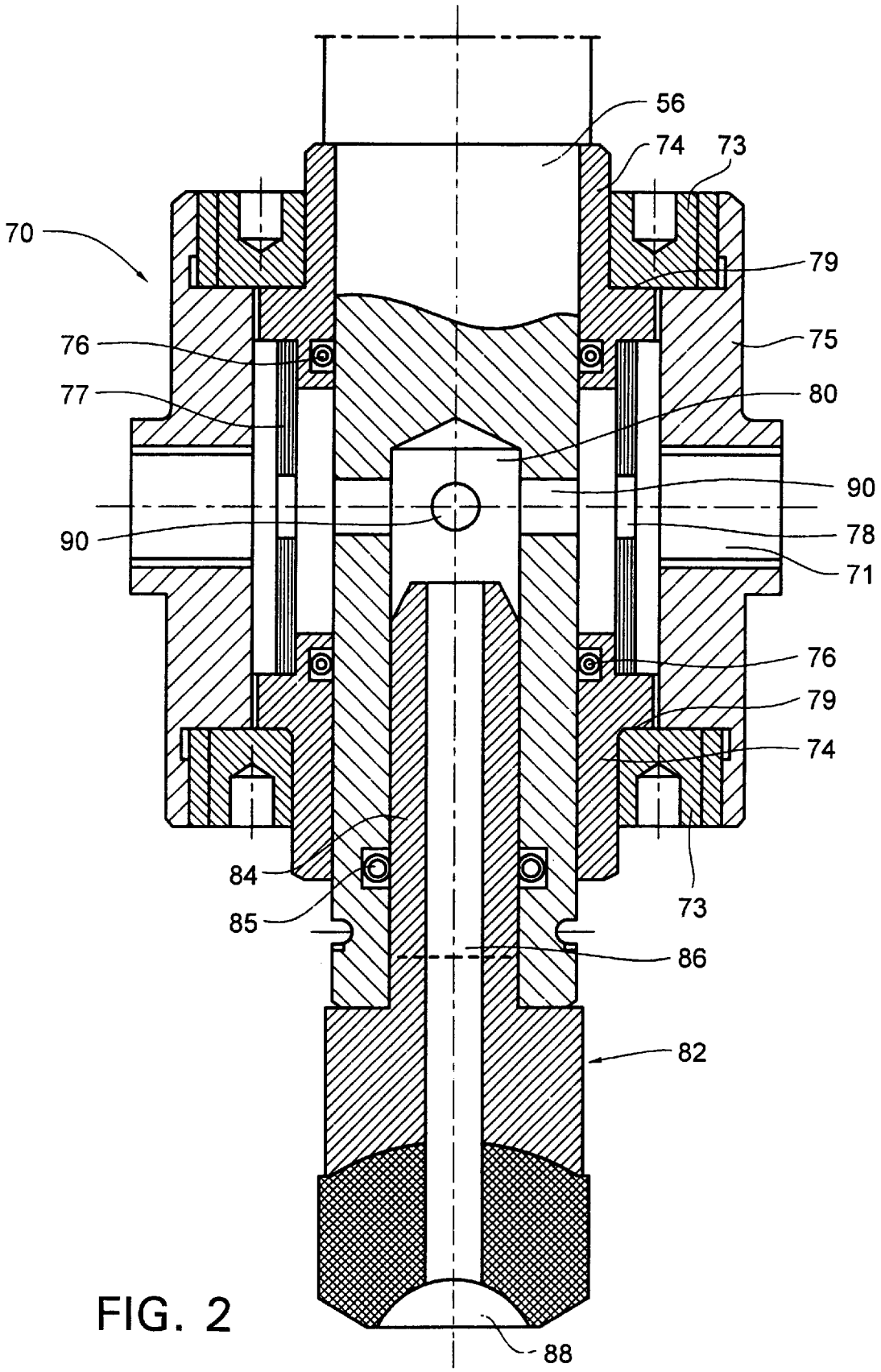

The end of the grinding spindle 56 that protrudes out of the outer casing 14 carries a flushing head 70 that is described more in detail in FIG. 2. The flushing head 70 is provided with two diametrically located openings 71 that receive hoses 72 that supply flushing medium from a suitable source (not shown). The connection of the hoses 72 to the source prevents a part of the flushing head 70 to rotate when the grinding spindle 56 is rotated. This is explained more in detail below.

In FIG. 2 the flushing head 70 is shown in a larger scale. The flushing head 70 includes two sealing sleeves 74 that surround the grinding spindle 56. The sealing against the grinding spindle 56 is effected via an O-ring 76 in each sealing sleeve 74, said O-ring 76 being received in an internal circumferential groove in each sealing sleeve 74. In order to position the sealing sleeves 74 axially apart on the grinding spindle 56 there is provided a spacing tube 77 that surrounds the opposing ends of the sealing sleeves 74 and an intermediate portion of the grinding spindle 56. The spacing tube 77 is provided with a number of openings 78 that admit flushing medium to reach the intermediate portion of the grinding spindle 56. The fit between the grinding spindle 56, the O-rings 76 and the sealing sleeves 74 is such that the sealing sleeves 74, together with the spacing tube 77, are driven when the grinding spindle 56 is rotated. The flushing head 70 further includes a radially outer portion having two rings 73 and a house 75. The rings 73 are provided with external threads and the rings 73 are mounted in the axial ends of the house 75 via cooperating threads in said house 75. The rings 73 and the house 75 of the flushing head 70 remain stationary when the grinding spindle 56 is rotated. Thus, there should be friction between the sealing sleeves 74 and the grinding spindle 56 but preferably no friction between the sealing sleeves 74 and the rings 73.

When the flushing medium within the flushing head 70 is pressurized the sealing sleeves 74 are further urged apart and there is established axial sealing faces 79 between the rotating sealing sleeves 74 and the stationary rings 73.

As is shown most clearly in FIG. 2, the free end of the grinding spindle 56 is provided with a first axial boring 80 that receives a shank 84 of a grinding cup 82, said shank 84 being secured axially by an O-ring 85 mounted in the first axial boring 80. The shank 84 is further provided with a through-going second axial boring 86 that emanates in a recess 88 in the head of the grinding cup 82. A key/slot arrangement (not shown) between the head of the grinding cup 82 and the free end of the grinding spindle 56 drives the grinding cup 82 when the grinding spindle 56 is rotated. A number of radial borings 90 extend from the periphery of the grinding spindle 57 to the region of the bottom of the first axial boring 80 thus establishing a communication for the flushing medium between the outside of the grinding spindle 56 and the first axial boring 80.

The device described above according to the present invention functions in the following way. The grinding head 10 is lowered and simultaneously the drill bit is displaced laterally until the recess 88 in the grinding cup 82 is properly positioned relative to the button to be ground. The drill bit is then locked in its position. The electric motor 12 is started and the driving sleeve 22 and the spindle house 32 rotates as one unit. When the spindle house 32 rotates, it is realized that due to the fact that the third longitudinal centre axis 57 forms an acute angle with the first longitudinal centre axis 19 the grinding spindle 56 will move along a conical envelope surface. The rotation of the spindle house 32 is relatively slow, i.e. a typical value is about 40 r.p.m. However, simultaneously as the grinding spindle 56 moves along the conical surface the grinding spindle 56 itself rotates relative to its longitudinal centre axis 57. Said last-mentioned rotation is considerably faster fi the rotation of the spindle house 32, i.e. a typical value for the grinding spindle 56 is 13000 r.p.m. This very large difference between the rotation speed of the spindle house 32 and the grinding spindle 56 is very favourable to the grinding action of the present device, i.e. vibrations in the device are reduced to an essential extent.

When the electric motor 12 starts, the supply of flushing medium, preferably water, to the flushing head 70 starts simultaneously. The flushing medium is supplied to the flushing head 70 via hoses 72 that are mounted in openings 71 of the flushing head 70. When the flushing medium has entered the flushing head 70 it passes through the openings 78 in the spacing tube 77 and then further through the radial borings 90 to the first axial boring 80. The flushing medium then enters the second axial boring 86 and emanates in the recess 88 of the grinding cup 82 to provide flushing/cooling of the button being ground.

The rotating grinding spindle 56 is via the grinding cup 82 performing the grinding of the chosen button. Since the flushing head 70 is positioned on the portion of the grinding spindle 56 that is located outside of the grinding head 10 the flushing medium will never enter the grinding head 10. This is a major advantage as regards a simplified design of the grinding head 10.

The invention is not in any way restricted to the embodiment described above but can be varied within the scope of the appending claims.

What is claimed is:

1. A flushing head adapted to be mounted on a rotatable grinding spindle which carries a grinding cup, for conducting flushing medium to an axial bore of said grinding spindle; said flushing head comprising a radially inner part having an axial through-bore adapted to be mounted on said grinding spindle for rotation therewith; said radially inner pat including a pair of axially spaced sleeves each carrying a seal for creating a fluid seal with the grinding spindle; said sleeves being axially separated by a cylindrical spacer; said spacer including a first opening extending radially therethrough at a location axially between said seals; said flushing head further including a stationary radially outer part connected non-fixedly to said sleeves in surrounding relationship to said spacer; said radially outer part including a second opening communicating with said first opening for conducting flushing fluid thereto.

2. The flushing head according to claim 1, wherein said spacer permits said sleeves to be moved axially relative to one another by a force of the flushing fluid and into sealing relationship with respective portions of said radially outer portion.

3. The flushing head according to claim 2, wherein said sleeves are movable axially away from one another by the force of the flushing fluid.

4. The flushing head according to claim 2, wherein each end of said spacer is slidably mounted on a cylindrical surface of a respective sleeve to enable said sleeves to slide axially relative to said spacer.

* * * * *